US005123556A

United States Patent [19]

Goldenberg

[11] Patent Number: 5,123,556

[45] Date of Patent: Jun. 23, 1992

[54] NON-OPENABLE CONTAINER

[75] Inventor: J. Melvyn Goldenberg, Upper Saddle River, N.J.

[73] Assignee: Polymer Technologies Inc., Clifton, N.J.

[21] Appl. No.: 755,630

[22] Filed: Sep. 5, 1991

[51] Int. Cl.[5] ..... B65D 41/04

[52] U.S. Cl. ..... 215/330

[58] Field of Search ..... 215/330, 332; 220/288

[56] References Cited

U.S. PATENT DOCUMENTS

| | | | |
|---|---|---|---|
| 2,153,426 | 4/1939 | McNamara et al. | 215/330 X |
| 2,980,275 | 4/1961 | Lundgren | 215/330 |
| 3,905,509 | 9/1975 | Markowitz | 220/319 |
| 3,977,557 | 8/1976 | Hazard | 215/274 |
| 4,281,778 | 8/1981 | Stull | 222/153 |
| 4,345,691 | 8/1982 | Burke | 215/216 |
| 4,373,641 | 2/1983 | Banich, Sr. et al. | 215/331 |
| 4,821,899 | 4/1989 | Nyez et al. | 215/235 |
| 4,934,547 | 6/1990 | Mayes et al. | 215/306 |
| 4,953,728 | 9/1990 | Meek | 215/250 |
| 5,000,332 | 3/1991 | Whitacre | 215/330 |

FOREIGN PATENT DOCUMENTS

| | | | |
|---|---|---|---|
| 646323 | 4/1961 | Italy | 215/330 |

*Primary Examiner*—Stephen P. Garbe
*Assistant Examiner*—Nova Stucker
*Attorney, Agent, or Firm*—Israel Nissenbaum

[57] ABSTRACT

A non-openable container such as for disposal of medical waste or containment of hazardous materials. The container is adapted for optional engagement with a removable cap prior to insertion of medical waste or hazardous materials and with a non-openable and non-breachable, one-way engaging cap which renders the container non-openable except with destruction of the container. To ensure secure non-openable closure of the container, the peripheral edge of the skirt of the one-way cap has a plurality of circumferentially arranged ramped teeth extending longitudinally on the interior wall of the cap to the lower edge of the skirt. These teeth cooperatively engage oppositely extending teeth on a shoulder of the container or other peripherally extending fixed-in place element. The opposing teeth mesh longitudinally and are held in a non-back-off position by the engaged threads, bayonet mount or other engaging means between the cap and container. The teeth are not externally accessible and attempted deformation of the cap and container causes them to move, if at all, as a unit without disengagement of the intermeshed teeth. The container and cap are constructed of break resistent low-deformable material to resist breakage and manipulative disengagement of the cap from the container.

2 Claims, 3 Drawing Sheets

NON-OPENABLE CONTAINER

This invention relates to one-way security caps for containers and particularly non-openable sealed containers.

Many security cap-container structures have been used for the purpose of making medication as well as poisonous and corrosive materials inaccessible to young children. The cap is placed on a bottle or other container for such materials and a cooperative engagement between elements on the cap and container prevent the cap from being easily removed. Lining up of elements, forceful pressure on the engaged threads and similar means which can be effected only by adults (or by adults with knowledge of the security overriding means), disengages the locking between cap and container and permits the cap to be removed without destruction or damage to either the cap or the container. U.S. Pat. Nos. 3,101,856 and 3,360,147 disclose various cooperative security locking means between cap and container whereby the flexibility of the container permits manipulative disengagement of the cap from the container. In many instances the inner portion of the cap and the outer portion of the container, in the area where the cap is seated, contain the cooperative locking members usually in only nominally holding engagement (sufficient to deter a child but not an adult). Pressure distortion of the cap or container readily causes disengagement.

Other types of caps are designed for being opened with access to the contents thereof but with a telltale indication that the container has been previously opened. A cap disclosed in U.S. Pat. No. 2,423,582 is anchored to a bottle with a frangible section which breaks off to indicate that the bottle had been opened previously. The actual opening is not however impeded.

In U.S. Pat. No. 4,736,859 a container is described for retaining urine for subsequent testing such as for drugs, wherein the container is closed in a manner whereby tampering with the contents thereof is precluded except with evidence of such tampering. In an embodiment thereof, a secured cap and container are described with a locking lateral engagement of teeth on the container and corresponding openings formed on the screw thread of the cap. With the openings being formed on the threads, only a small number of teeth and openings can be used. As a result, circumvention of the locking mechanism is simplified. In addition, this engagement is susceptible to removal by exertion of lateral forces to warp the cap or container sufficiently to cause disengagement therebetween. Accordingly, such structure is not useful for the permanent containment of medical waste or non-breachable containment of hazardous materials in general, though it may be useful to contain urine with tamper evidence means. Finally, because of the location of the teeth on the container threads, the container cannot be readily utilized with other non-conformed or removable caps. As a result it is only suitable for one-time immediate use.

It is an object of the present invention to provide a secure container-cap locking mechanism which is not openable and is not merely tamper evident.

It is a further object of the present invention to provide a container which can be used with both locking and non-locking caps;

It is a still further object of the present invention to provide a closure for a container without manipulative overrides and wherein the contents can be accessed only by destruction of the container.

These and other objects, features and advantages of the present invention will become more evident from the following discussion and the drawomgs in which.

Figure 1:
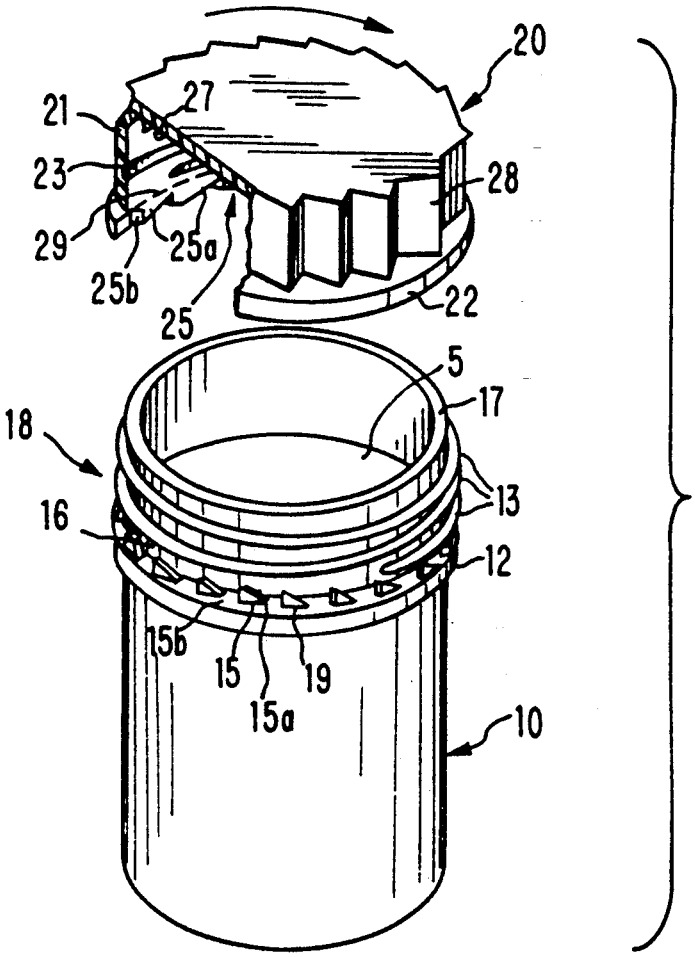
FIG. 1 is an isometric, partially cutaway view of a cap and container of the present invention being engaged.

Generally the present invention comprises a non-openable combination of container and cap which interlock with each other in a one way non-breachable manner. The container can be safely used for applications including the disposal of waste such as medical waste of the non-accessible containment of hazardous materials except by total container destruction.

In accordance with the present invention, the container comprises an aperture for material insertion, with a peripheral outwardly extending neck portion. In one embodiment hereof, the neck portion comprises a section of a vial-like cylindrical container. The neck portion comprises engaging means for retaining a cap thereon such as a screw-on thread or a bayonet mount. The container further comprises a shoulder or support member, peripheral to the neck portion, with the shoulder or support member extending away from the neck portion, preferably in a substantially perpendicular direction. The shoulder or support member may be an integral portion of the container or a separate element locked in place on the container. The shoulder or support member abuttingly engages the threaded (or otherwise engaged) cap placed on the neck of the container. A plurality of circumferentially positioned ramped teeth, in the form of solid right triangles, are suported by the shoulder or support member in a locus substantially or completely around the neck portion of the container. The teeth are of substantially congruent configuration and are uniformly and sequentially positioned in the same direction. The base of each right triangle is integral with the shoulder or support member with the hypotenuse or ramp section extending upwardly toward engagement with co-fitting teeth which extend downwardly from the inner lower peripheral edge of the cap. The peripheral edge of the skirt of the one-way cap has a plurality of circumferentially arranged ramped teeth extending longitudinally on the interior wall of the cap to the lower edge of the skirt. These teeth cooperatively engage oppositely extending teeth on a shoulder of the container. The direction of the ramps of the container teeth follows the direction in which the cap is rotated for engagement with the container. The engaged meshing, when the cap is threaded or otherwise engaged to the neck of the container, comprises the ramps of the opposing teeth co-extensively contacting each other. With continued engaging movement of cap on the container, the ramps of the teeth of the cap ride over the edge of the ramps of the teeth of the container. The cap cannot thereafter be backed off. The threads, bayonet mount or other engaging means prevent direct lift-off removal and the meshed teeth prevent rotational axial removal. The teeth of the container relative to those of the cap used not be of similar dimension, number or emplacement and need only be capable of intermeshing as described.

To ensure positive and relatively easy engagement between the teeth, the ramp angles of the teeth of both the container and cap are preferably less than 45° and more preferably less than 5° and the ramps are elongated to facilitate this engagement of the corresponding teeth of cap and container. A preferred height to base length of the ramps is about 1:10. In general, to facilitate locking placement of the cap on the container, the more rigid the material of the teeth and the base support for the teeth, the smaller the angle and the shorter the perpendicular height of the ramp. The number of engaging teeth of both cap and container is a function of the circumference around the neck of the container and the length of the ramp section of each of the teeth. The greater the circumference, the greater the number of teeth and the longer the ramp the fewer the teeth. The teeth should be closely spaced and should preferably completely surround the neck. In the embodiment wherein a separate support element is seated on the neck, the teeth should extend at least around two thirds of the circumference of the neck. The number of engaging teeth should be sufficient to surrond the container opening and whereby external pressure to disengage some of the teeth will only serve to reinforce engagement between other teeth. To ensure non-breachable engagement, each of the cap and container should have a minimum of six and preferably at least eight teeth for engagement.

To protect the meshed teeth from possible tampering, a skirt on the cap preferably encloses the teeth of the cap from external prying or tampering. The neck of the container completes the enclosure of the meshed teeth and prevents inward pushing of the teeth for disengagement. Preferably the teeth are relatively arranged to engage with each other whereby the upper edge of the neck of the container is sealingly abutted against the interior of the cap top to prevent leakage. For structural integrity of the base from which the teeth extend from the container, it is preferred that the teeth of the container be spaced apart from each other. To deter tampering it is also preferred that there is little or no play in the engaging means between the cap and container whereby the cap can be slightly lifted to effect disengagement between the teeth.

To overcome the resistance offered by the meshing teeth, particularly if the ramp angles are large, it is preferred that the cap further comprises tightener enhancing means. Examples of tightener enhancing means include knurled or stepped caps which provide for enhanced gripping with concomitant greater ability to exert increased torque for tightening. The material of the teeth should be supported by a base made of a material having sufficient give to permit the teeth to be properly meshed, but not of excessive flexibility which will permit tampering removal. Rigid plastics such as polycarbonate are preferred materials for the cap and container of the present invention.

Because of the longitudinal extension of the teeth from the shoulder of the container, there is no impediment to the temporary utilization of a regular non-locking cap. The teeth, at most, merely function as an elevated base for the ordinary cap. Alternatively, instead of directly providing the shoulder of the container with the locking teeth, a separate yoke with such teeth may be effectively utilized. In such embodiment the container remains an ordinary one for use with ordinary caps. The yoke, preferably with a U-shape, is adapted to axially engage the neck of the container. Right angled ramped teeth extend upwardly from the yoke in a partially circular configuration around the curve of the U. The partially circular configuration is concentric to the neck of the container when the yoke is engaged with the neck of the container. The track of the teeth on the yoke corresponds to that of the teeth on the cap of the container with the teeth of the yoke being correspondingly positioned relative to the teeth of the cap to cause locking engagement between the sets of teeth when the cap is seated on the neck of the container. With such locking engagement, the yoke is compressed against the shoulder of the container or other support thereof. One way cam locks preferably hold the yoke in place on the neck. Engaged locking between the yoke and the cap also serves to lockingly position the yoke in place. A circular yoke may be utilized if the container is substantially cylindrical as in the shape of a vial.

Though other applications for non-openable containers are possible, such as storage of hazardous materials to prevent unauthorized opening, the present invention is particularly useful for the application described in U.S. Pat. No. 4,971,261 in which a device is described for the fragmentation and sanitization of medical waste. The resultant fragmented and sanitized waste is contained within a container for disposal. For absolute safety such container is sealingly closed in accordance with the present invention when filled and ready for disposal. Because of the virulent nature of medical waste it is imperative that it be disposed of in a container which cannot be breached even though it has been sanitized. In addition, the container must be capable of being attached to a removable cap of the disposal system and be removable for later sealing closure.

With specific reference to the drawings, FIG. 1 shows locking cap 20 being seated on container 10 after the insertion of materials such as hazardous materials or medical waste into container 10 via opening 5. Internal threads 23, in the cap, thread onto corresponding threads 13 on the neck 18 of container 10. With continued threading and tightening of cap 20 on container 10 (aided by stepped tightening enhancer 28), container teeth 15, extending upwardly from container shoulder 12, engage downwardly extending cap teeth 25. Ramp surfaces 15*a* of container teeth 15 slidingly engage ramp surfaces 25*a* of cap teeth 25. Perpendiculars 25*b* of the cap teeth 25 thereafter abuttingly engage perpendiculars 15*b* container teeth 15 thereby preventing backing off of the cap 20 from the container 10. Ramp angles 19 and 29 of cap and container teeth 25 and 15 respectively are substantially equal to facilitate the sliding engagement and abutting engagement of the perpendiculars 15*b* and 25*b*. The dotted lines indicate where the teeth 25 can be removed to provide a non-locking cap structure which can be seated without locking on container 10. Container open edge 17 abuttingly engages inside cap surface 27, when the cap 20 is fully seated on container 10, to seal the container against liquid leakage. For structural strength, teeth 15 are spaced apart on shoulder base 12. The engaged teeth 15 and 25 are completely enclosed by thickened portion 22 of cap 20 and neck wall 16. As a result, manipulative disengagement of the interlocked teeth is prevented in all directions.

Figure 2:
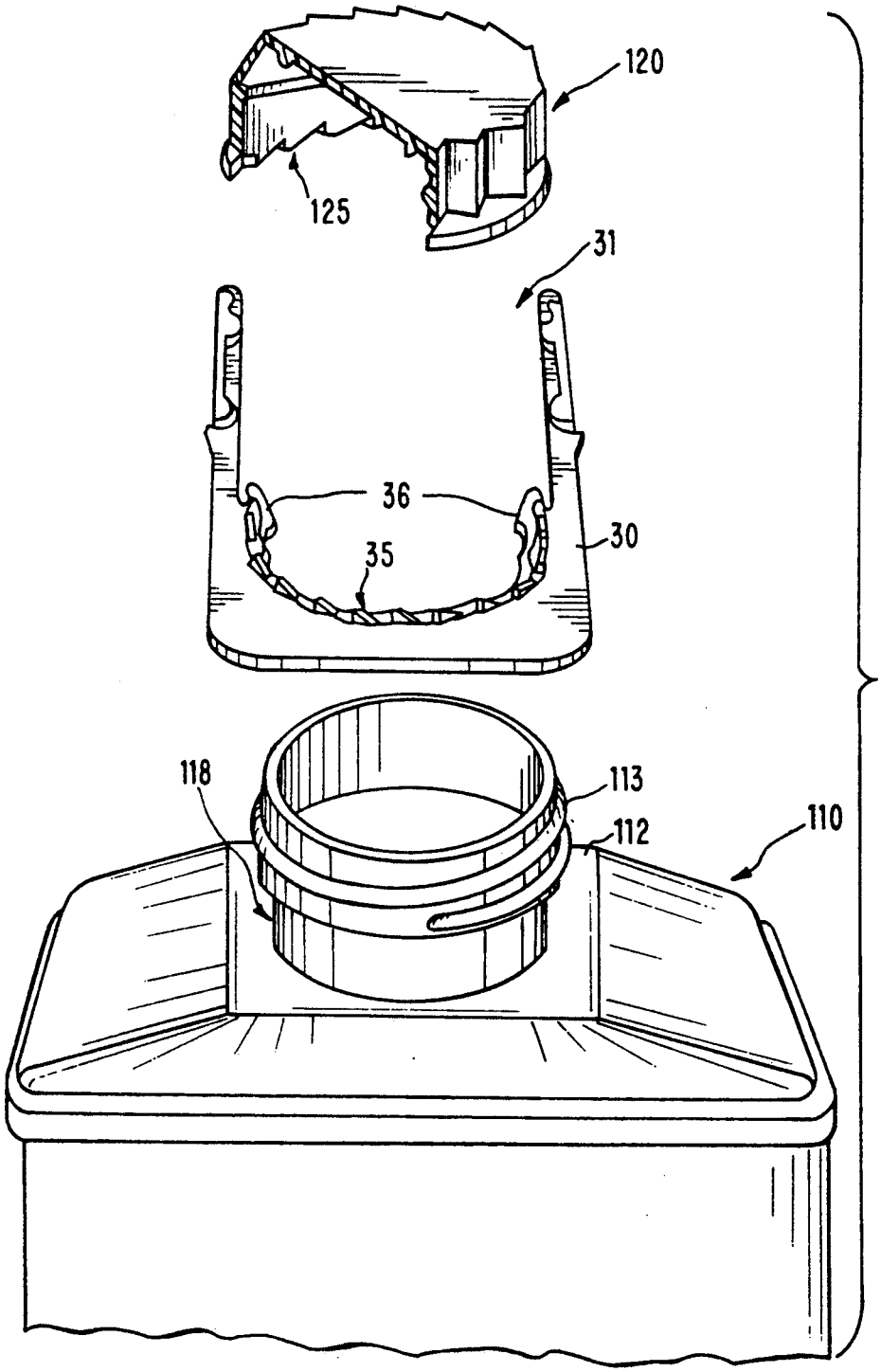
FIG. 2 is a blow up view of a second embodiment of the present invention with a container, locking yoke and cap.
Figure 3:
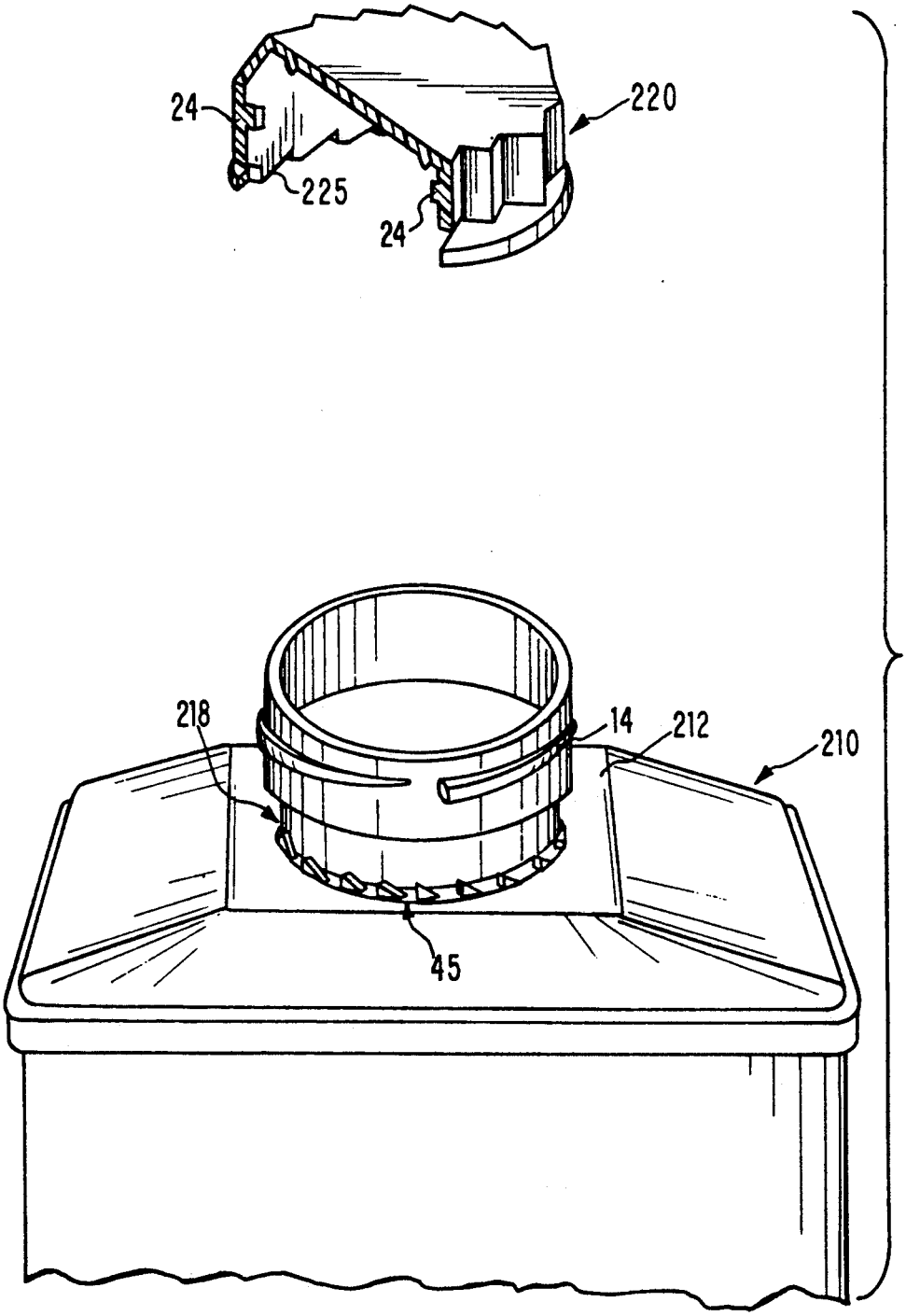
FIG. 3 is an alternative view of cap and container wherein they are interconnected with a bayonet connection.

In FIG. 2, container 110 is an ordinary container. Locking yoke 30 is fitted onto neck 118 of container 110 via yoke open end 31. Cam locks 36 hold the yoke in place on neck 118 against shoulder 112 until cap 120 is threadingly seated on threads 113 of the container neck. Cap teeth 125 lockingly engage yoke teeth 35 in the same manner as described with respect to the container of FIG. 1. The locking engagement also fixes the yoke 30 in non-removable position.

In FIG. 5 another embodiment is shown wherein the cap-container engagement is effected via bayonet engagement between members 14 of the container 210 and cofitting extensions 24 on cap 220. Cap teeth 225 lockingly engage teeth 45 in a manner as described above. In this embodiment teeth 45 are integrated with the shoulder 212 with the teeth closely surrounding neck 218.

It is understood that the above embodiments merely exemplify aspects of the present invention and details contained therein should not be construed as limitations on the present invention. Changes in structrue, components and relative positions are possible without departing from the scope of the present invention as defined in the following claims.

What is claimed is:

1. A non-openable container comprising a cap, having a base and a depending skirt, having an inner wall which comprises an interior wall of the cap, and a container comprising a receptacle body and an extending neck section with an aperture therein for introduction of material into the container, with the cap and container having co-fitting engaging means, with the engaging means of the container being positioned on the neck section, and with the cap being adapted to sealingly close said aperture and enclose said neck section therewithin with the depending skirt, characterized in that a support member peripherally and outwardly extends from the neck section, at a position removed from the co-fitting engaging means and opposite that of the aperture, the support member having a plurality of circumferentially and sequentially arranged teeth members thereon extending upwardly in a direction towards the aperture; wherein the cap comprises teeth members circumferentially positioned on the interior wall of the cap at the lower peripheral edge of the skirt and extending towards an open end of the cap; wherein the teeth members of the container and cap are adapted to cooperatively interlock with each other when the cap and container are engaged with the co-fitting engaging means; wherein the teeth members of both container and cap comprise solid right triangles with the base of the right triangles of the teeth members of the container being integral with the support member; wherein the support member comprises a separate yoke element fixedly placed on the container; wherein the interlock between the teeth members of the container and cap cannot be reversed and wherein the yoke element comprises a U-shaped configuration adapted to be peripherally engaged with the neck section and locked into position thereon.

2. The non-openable container of claim 1 wherein the teeth member on the separate yoke element circumferentially enclose at least about two thirds of the circumference of the neck section.

* * * * *